US009982484B2

(12) United States Patent
Siller

(10) Patent No.: US 9,982,484 B2
(45) Date of Patent: May 29, 2018

(54) CLOSURE MEMBER CONTROL SYSTEM

(71) Applicant: Stöbich Brandschutz GmbH, Goslar (DE)

(72) Inventor: Stefan Siller, Lutter am Barenberge (DE)

(73) Assignee: Stoebich Brandschutz GmbH, Goslar (DE)

( * ) Notice: Subject to any disclaimer, the term of this patent is extended or adjusted under 35 U.S.C. 154(b) by 0 days. days.

(21) Appl. No.: 15/216,227

(22) Filed: Jul. 21, 2016

(65) Prior Publication Data

US 2018/0023342 A1 Jan. 25, 2018

(51) Int. Cl.

| | |
|---|---|
| ***E06B 9/17*** | (2006.01) |
| ***E06B 9/68*** | (2006.01) |
| ***E06B 5/16*** | (2006.01) |
| ***E06B 5/12*** | (2006.01) |

(52) U.S. Cl.

CPC ..... *E06B 9/68* (2013.01); *E06B 5/12* (2013.01); *E06B 5/16* (2013.01); *E06B 2009/6809* (2013.01)

(58) Field of Classification Search

CPC ..... E06B 9/17007; E06B 9/17015; E06B 9/17023; E06B 9/64

USPC ..... 160/243, 242, 253, 252, 258, 254, 255, 160/307, 308, 319, 277

See application file for complete search history.

(56) References Cited

U.S. PATENT DOCUMENTS 1,996,108 A * 4/1935 Herr ..... E06B 9/66 160/122
1,997,912 A * 4/1935 Phinn ..... E06B 9/64 160/243
2,083,726 A * 6/1937 Mason ..... E04F 10/0614 160/22
2,506,209 A * 5/1950 Glass ..... G09F 17/00 160/23.1
3,050,075 A * 8/1962 Kaplan ..... B60J 11/02 135/115
3,076,975 A * 2/1963 Lamb ..... E04H 4/101 160/26
4,077,474 A * 3/1978 Hattori ..... A62C 2/10 160/1
4,164,972 A * 8/1979 Bennett ..... B60P 3/343 135/88.12
4,554,768 A * 11/1985 Srajer ..... B65G 69/008 160/243
5,121,782 A * 6/1992 Renkhoff ..... E04F 10/0618 160/22
5,195,594 A * 3/1993 Allen ..... A62C 2/10 160/243
5,383,510 A * 1/1995 Allen ..... A62C 2/10 160/243

(Continued)

FOREIGN PATENT DOCUMENTS

GB 2050641 A * 1/1981 ..... E06B 9/64

*Primary Examiner* — Katherine W Mitchell
*Assistant Examiner* — Johnnie A. Shablack
(74) *Attorney, Agent, or Firm* — Whitham, Curtis & Cook, P.C.

(57) ABSTRACT

A closure member control system for roll down smoke and/or gas barrier system includes a closure member which, when closed, maintains a spool with the barrier wound thereon within a housing. On deployment, the closure member opens and is prevented from closing by one or more cords connected to the spool.

9 Claims, 5 Drawing Sheets

(56) References Cited

U.S. PATENT DOCUMENTS 5,549,347 A * 8/1996 Anderson ..... B60J 7/085 160/243
5,632,317 A * 5/1997 Krupke ..... E06B 9/13 160/264
6,099,610 A * 8/2000 Palmer ..... A45D 44/02 137/527.8
7,000,668 B2 * 2/2006 Sears ..... E06B 9/13 160/2
7,028,742 B2 * 4/2006 Sears ..... E06B 9/13 160/243
7,089,992 B2 * 8/2006 Walter ..... B60J 1/2027 160/370.22
7,114,543 B2 * 10/2006 Heitel ..... E04F 10/0685 160/11
7,204,291 B2 * 4/2007 Last ..... E04H 4/082 160/133
7,299,848 B2 * 11/2007 Streib ..... E06B 9/17007 160/243
7,735,539 B2 * 6/2010 Nakamura ..... A62C 2/10 160/243
7,798,198 B2 * 9/2010 Rejc ..... E06B 9/08 16/194
8,011,413 B2 * 9/2011 Poppema ..... E05D 13/12 160/23.1
8,215,697 B1 * 7/2012 Lin ..... B60J 1/2027 160/23.1
8,789,576 B2 * 7/2014 Krueger ..... A62C 2/18 160/133
8,857,491 B2 * 10/2014 Kimener ..... E06B 9/17076 160/23.1
8,899,297 B2 * 12/2014 Mazej ..... E06B 9/08 160/133
8,953,327 B1 * 2/2015 Salmon ..... G06F 1/1652 160/242
9,512,669 B2 * 12/2016 Sentjurc ..... E06B 9/17076
2003/0051829 A1 * 3/2003 Sears ..... E06B 9/13 160/243
2006/0226103 A1 * 10/2006 Streib ..... E06B 9/17007 211/180
2012/0180960 A1 * 7/2012 Oya ..... B60J 1/2038 160/370.21

* cited by examiner

CLOSURE MEMBER CONTROL SYSTEM

FIELD OF THE INVENTION

The invention generally relates to fire and/or smoke barrier systems and particularly to roll down smoke and/or gas barrier systems.

BACKGROUND

Smoke and in noxious gases can be very dangerous to occupants during a building fire. Generally, noxious gases pose a more significant risk to the occupants than the fire itself. This is particularly true for multi-story buildings that are equipped with an elevator. Elevator shafts provide significant paths by which smoke and noxious gases can spread rapidly throughout a building, thus putting even those occupants of a building in danger who are far away from the fire.

To prevent the spread of dangerous gases, many devices and assemblies have been designed to cut off possible paths for gases. For example, U.S. Pat. No. 7,028,742 B2 describes a system and method for sealing openings and in response to smoke, noxious fumes, or contaminated air using a roll-down barrier. A similar solution has been disclosed in US 2006/0226103 A1, U.S. Pat. No. 5,195,594, and U.S. Pat. No. 5,383,510.

A typical high-rise building has many elevator doors and thus requires a significant number of these systems.

It is desirable to have a simple and robust closure member control system in place.

Due to the law and regulations, fire and/or smoke protection systems must be tested regularly, e.g. every few months. It is desirable to make these tests as easy and as a little time-consuming as possible.

SUMMARY

An exemplary embodiment of the invention is to provide a closure member control system that overcomes the drawbacks of the prior art.

An exemplary closure member control system would include a housing, a fire and/or smoke barrier which is at least partially wound and unwound from a spool, and a drive mechanism for moving the barrier between a stowed and a deployed position. The housing has an interior, and opening to the interior, and closure member which is movable relative to the opening between an open and a closed position. The closure member covers at least a portion of the opening in the closed position and does not cover the portion when in the open position. The fire and/or smoke barrier is coupled to the housing and moves between a stowed position and a deployed position. The barrier is located within the interior of the housing when it is in the stowed position, and extends past the opening to the housing interior when in the deployed position. The barrier is wound on a spool located generally within the interior of housing. The drive mechanism is operatively coupled to the barrier such that it can drive the barrier to at least one of the stowed position and the deployed position. The drive mechanism includes one or more cords coupled to the spool, for example, on each side of the spool, which retain the spool and the barrier in the stowed position. The cord(s) is movable to lower the spool and a portion of the barrier past the opening in the housing as the barrier moves from the stowed position to the deployed position. The closure member is position to be prevented from closing by means of the cord(s) when the closure member is in the open position.

DETAILED DESCRIPTION

Figure 1:
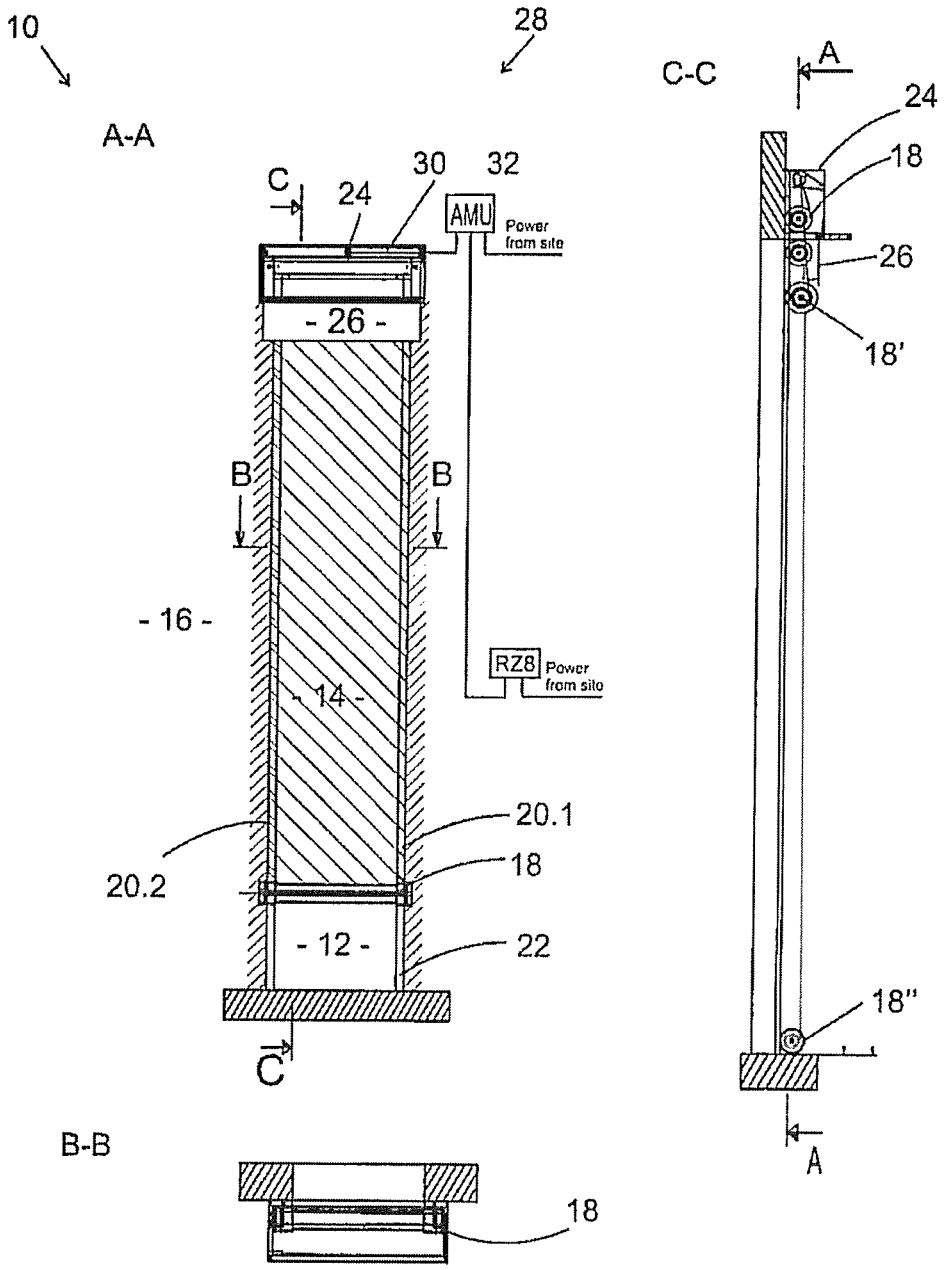
FIG. 1 shows cross sectional views of an embodiment of the present invention. The fire and/or smoke barrier is shown in a position between a stowed position and a deployed position in the A-A cross sectional view.

FIG. 1 shows a fire and/or smoke protection system 10 for reversibly shutting off an opening 12, e.g. an elevator door, by means of a fire and/or smoke barrier 14. The opening 12 is provided in a wall 16 of a building.

The fire and/or smoke barrier 14 can be wound on a spool 18. The fire and/or smoke barrier 14 comprises a magnetic strip 20.1 and 20.2 on each side for attachment to a ferromagnetic frame 22 of the opening 12. Magnetic strips 20.1, 20.2 provide a smoke-proof seal so that the fire and/or smoke barrier 14 can seal off the opening 12 in a smoke proof way.

The fire and/or smoke protection system 10 comprises a housing 24 that may be made from a metal sheet or another suitable material. When the fire and/or smoke barrier 14 is completely wound on the spool 18, it is located within the housing 24, as can be seen in the right picture depicting a sectional view along C-C and with reference to FIG. 2. When the fire and/or smoke barrier 14 is partly unwound from the spool, the spool 18'—takes the position that is drawn in dashed lines. The reference numeral 18" shows the spool in its deployed position.

The housing 24 comprises a closure member 26, which may be a flap, as will be described in more detail below.

The fire and/or smoke protection system 10 has a drive mechanism 28, motor 30 and a control 32. The control 32 is connected to a central alarm system. If the central alarm system sends an alarm signal or fails to send an ok signal, the control 32 interrupts the power supply of the motor 30 so that the spool 18 with the fire and/or smoke barrier 14 wound on it moves down, e.g., because of its own weight. In this case, the motor 30 acts as brake so that the speed of the spool 18 does not exceed a preset maximum speed.

Figure 2:
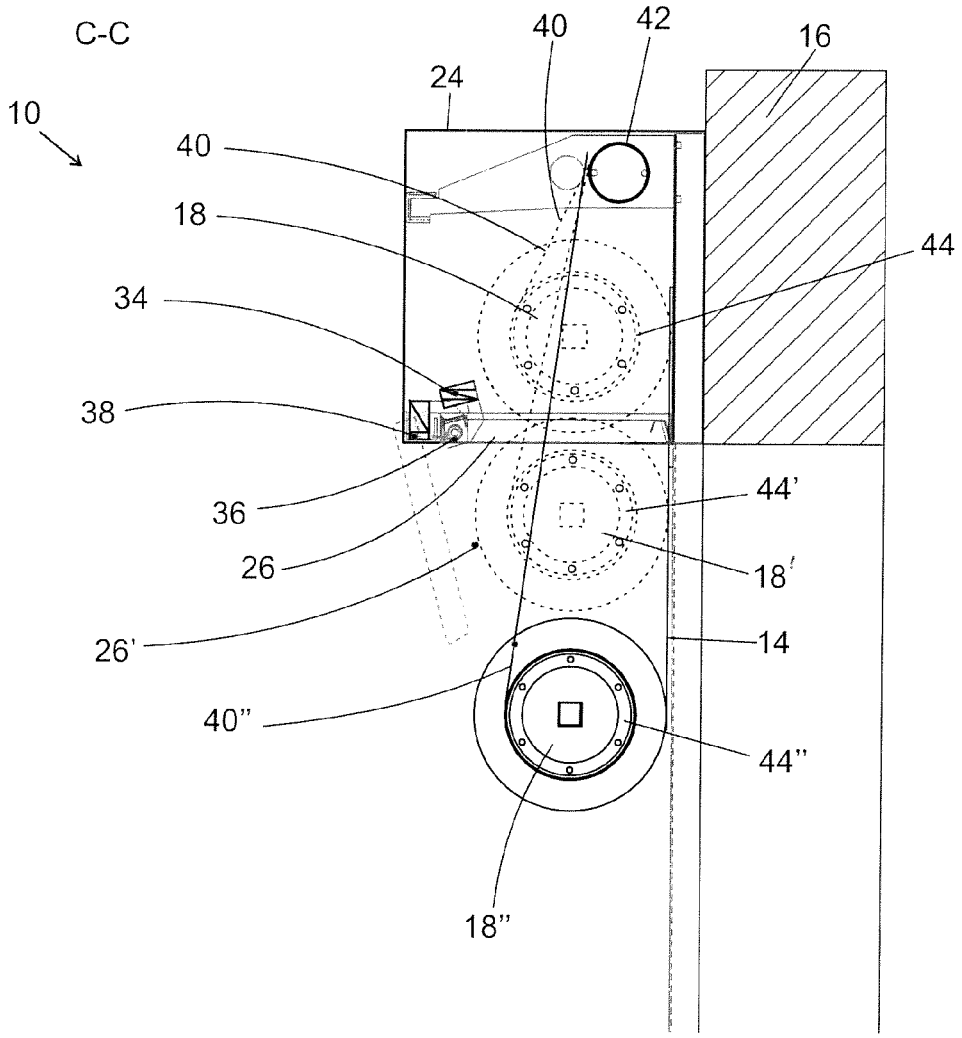
FIG. 2 shows the cross section of an embodiment of the present invention, wherein the spool with the fire a smoke barrier is shown in the stowed position and in two positions between the stowed position and the deployed position (identified by dashed lines).

FIG. 2 shows a detailed cross section of the fire and/or smoke protection system 10 according to FIG. 1. FIG. 2 shows that the closure member 26 is pivotably mounted to the housing 24. The housing 24 is mounted to the wall 16 e.g. by screws (not shown). The reference numeral 18 refers to the spool in its stowed position. The spring 36 or the counter weight 34 may be omitted. However, the combination of both can be particularly advantageous.

The fire and/or smoke protection system 10 may comprise a magnet 38. It is possible that the counter weight 34 also is, is associated with, or forms at least part of the magnet 38. In this embodiment the magnet 38 may cling to the housing 24, as shown in FIG. 2. The counter weight 34 is then preferably made from a ferromagnetic material, e.g. steel or iron. The magnet 38 firmly closes the flap 26 when it is in its closed position, e.g. when the spool 18 is in its stowed position.

When the motor 30 is no longer powered or receives a signal to deploy the fire and/or smoke barrier 14, a cord 40 may be unwound from a spool 42 that is connected to the motor 30. As the spool 42 turns, the cord 40 may be wound onto a bobbin 44 that is connected to the spool 18 or is part of it. After a short period of time, the cord 40 (as well as the assemblage 18) comes in contact with the flap 26 and pushes it open, as is shown in solid line 40". The closure member 26 is thus prevented from closing by the cord 40".

Figure 3A:
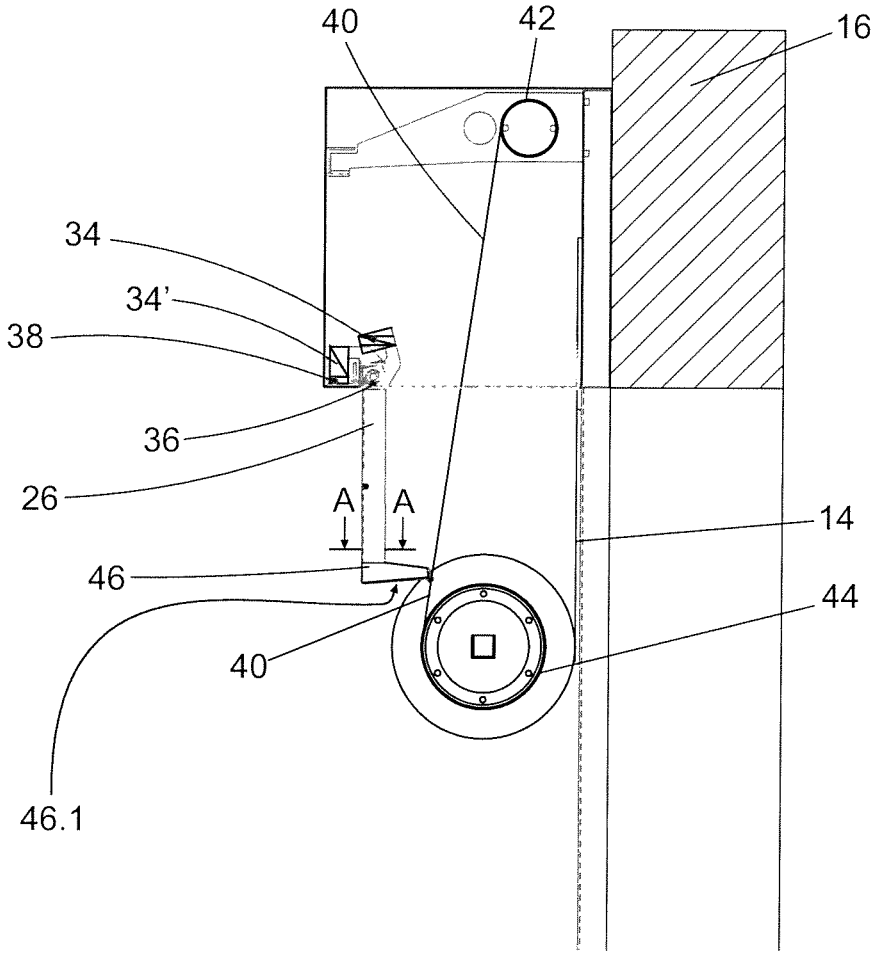
FIGS. 3*a* and 3*b* show respectively side and cross-sectional views of another embodiment of the present invention in which the closure member has tip elements for contacting the cords.
Figure 3B:
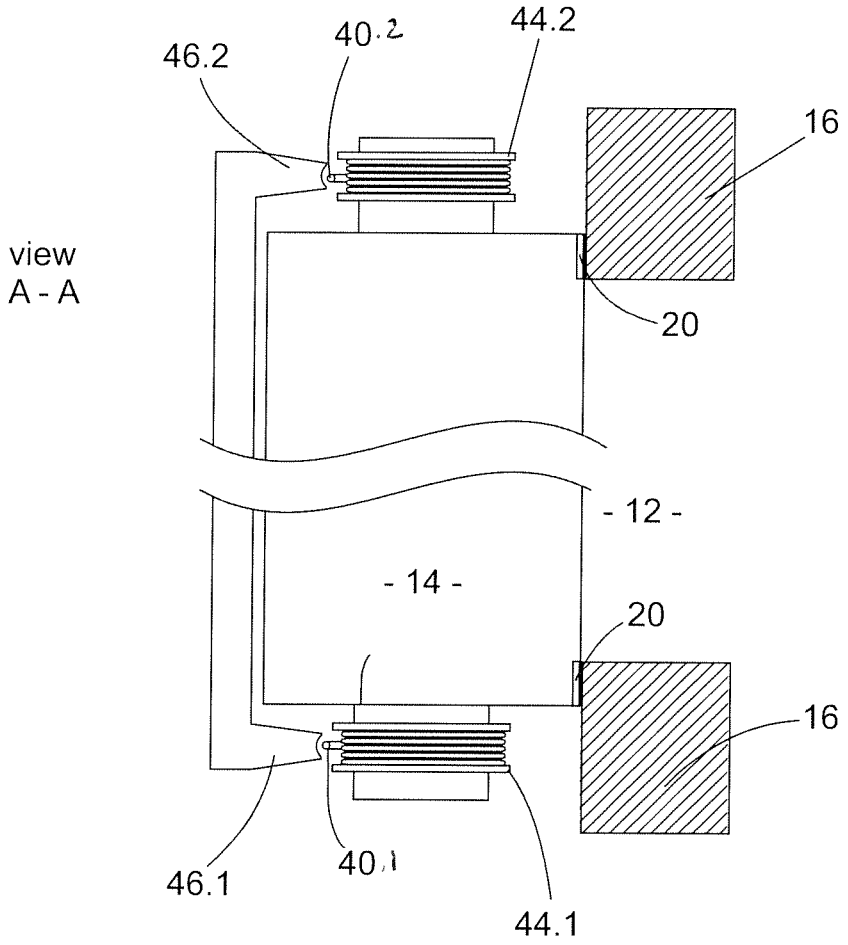

FIGS. 3*a* and 3*b* shows another embodiment of the present invention in which the closure member 26 comprises tip elements 46.1, 46.2 that are designed so that they can only contact the cord 40, as opposed to either the bobbin 44 and the fire and/or smoke barrier 14. As shown in FIG. 3B, there may be two strings of cord 40.1, 40.2 that are separate from each other and are each wound onto one bobbin 44.1 and 44.2 respectively. As an alternative, there may be only one cord having two sections on each side of the fire and/or smoke barrier 14. As illustrated in FIG. 3*a*, the tip elements 46.1 and 46.2 can be partially concave for better interaction with the cords, and may also be magnetic. The cord(s) 40, 40.1, or 40.2 may be made of or include a ferromagnetic material such as steel or iron so that the cord may be attracted by magnetic tip elements.

Figure 4A:
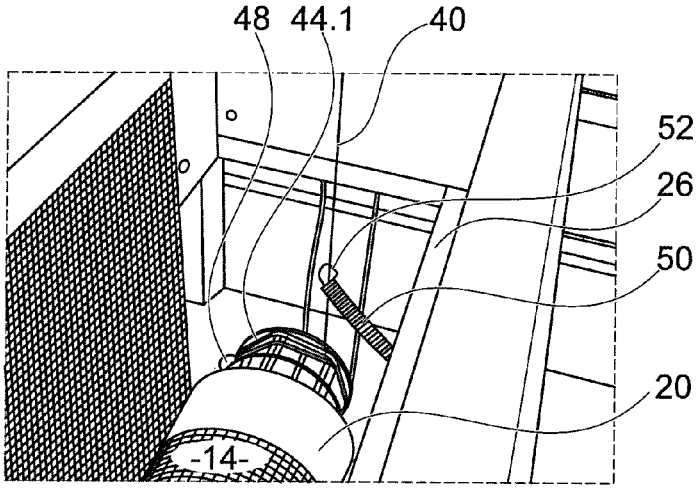
FIGS. 4*a*, 4*b*, 4*c* show a further embodiment of the present invention in which the cord has a thickening and the closure member has an eye for positive engagement with the thickening in order to close the closure member.
Figure 4B:
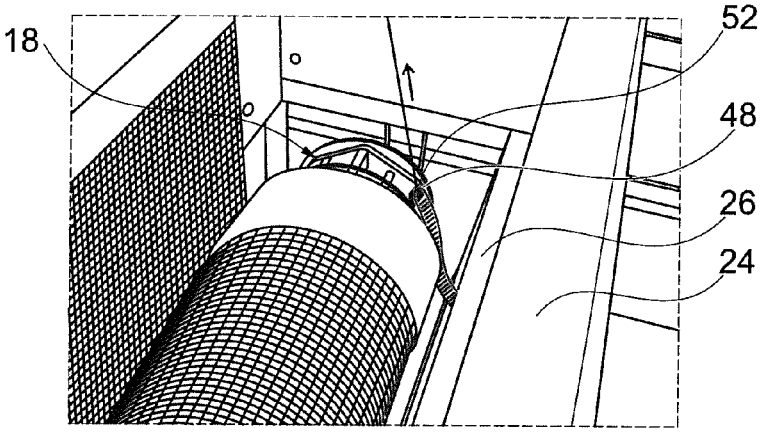
Figure 4C:
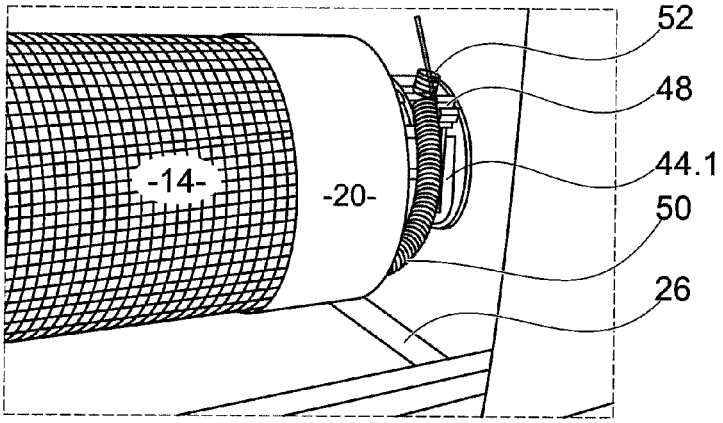

FIGS. 4*a* to 4*c* show another embodiment of the present invention in which the cord 40 that is wound onto the bobbin 44.1 comprises a thickening 48 which may be glued or screwed or otherwise fastened to the cord 40. In the position shown in FIG. 4*a*, the part of the cord 40 with the thickening 48 is wound on the bobbin 44.1.

The closure member 26 comprises a spring element 50 that has an eye 52. The cord 40 runs through the eye 52. The eye 52 is big enough so that the cord 40 can past through the eye 52 more or less unaffectedly, but too small for the thickening 48.

FIG. 4*b* shows a situation in which the thickening 48 has reached the eye 52. Further upward motion of the cord 40 in order to a move the spool 18 in the upward direction will cause a locking engagement of the thickening 48 with the eye 52. As a consequence, the eye 52 will be moved in the upward direction thus tensioning the spring element 50. This causes the closure member 26 to close.

FIG. 4*c* shows situation in which the spring element 50 has closed the closure member 26. In this embodiment, there is no need for a counter weight or a magnet. However, it is also possible to provide a counter weight and/or a magnet as shown in FIG. 3*a*.

I claim:

1. A closure member control system, comprising:

(i) a housing comprising an interior, an opening to the interior, and a closure member movable relative to the opening between open and closed positions, the closure member in the closed position covers at least a portion of the opening and in the open position does not cover the at least a portion of the opening;

(ii) a fire or smoke barrier coupled to the housing and being moveable between a stowed position and a deployed position, the barrier being contained in the interior of the housing when in the stowed position, and the barrier in the deployed position extending past the opening;

(iii) a spool coupled to the barrier, wherein at least a portion of the barrier is wound on the spool, and wherein the barrier and the spool are generally positioned in the interior of the housing when the barrier is in the stowed position;

(iv) a drive mechanism operatively coupled to the barrier and positioned to move the barrier to at least one of the stowed position and the deployed position; and (v) one or more cords coupled to the spool to retain the spool and the barrier in the stowed position, at least one of the one or more cords being movable to lower the spool and a portion of the barrier past the opening in the housing as the barrier moves from the stowed position to the deployed position, wherein the closure member of the housing is positioned to be prevented from closing by the one or more cords when the closure member is in the open position, wherein the closure member includes one or more tips which contact the one or more cords only when the closure member is in the open position.

2. The closure member control system according to claim 1, wherein the closure member is pivotably coupled to the housing, and further comprising a counter weight for urging the closure member into the closed position.

3. The closure member control system according to claim 1, further comprising a spring for urging the closure member into the closed position.

4. The closure member control system according to claim 1 wherein the one or more tips are at least partially concave.

5. The closure member control system of claim 1, wherein the one or more cords includes two cords coupled to the spool, one on each side of the spool.

6. The closure member control system according to claim 1 wherein the one or more tips are magnetic.

7. The closure member control system according to claim 6, wherein the one or more cords include a ferromagnetic material.

8. A closure member control system, comprising:

(i) a housing comprising an interior, an opening to the interior, and a closure member movable relative to the opening between open and closed positions, wherein the closure member in the closed position covers at least a portion of the opening and in the open position does not cover the at least a portion of the opening;

(ii) a fire or smoke barrier coupled to the housing and being moveable between a stowed position and a deployed position, the barrier being contained in the interior of the housing when in the stowed position, and the barrier in the deployed position extending past the opening;

(iii) one or more spools coupled to the barrier wherein at least a portion of the barrier is wound on the one or more spools, and wherein the barrier and the one or more spools are generally positioned in the interior of the housing when the barrier is in the stowed position;

(iv) a drive mechanism operatively coupled to the barrier and positioned to move the barrier to at least one of the stowed position and the deployed position; and (v) one or more cords wherein the one or more cords are each coupled to one of the one or more spools to retain the spool and the barrier in the stowed position, at least one of the one or more cords being movable to lower the spool and a portion of the barrier past the opening in the housing as the barrier moves from the stowed position to the deployed position, wherein the at least one of the one or more cords has a thickening, and the closure member has an eye for the at least one of the one or more cords, the eye engaging the thickening when the closure member is in the closed position and disengaging the thickening when the closure member is in the open position.

9. The closure member control system according to claim 8, further comprising a spring element for each eye.

* * * * *